US005092410A

United States Patent [19]

Wallace et al.

[11] Patent Number: 5,092,410

[45] Date of Patent: Mar. 3, 1992

[54] ADJUSTABLE PRESSURE DUAL PISTON IMPULSE CLUTCH

[75] Inventors: William K. Wallace, Barneveld, N.Y.; Knut C. Schoeps, Tyreso, Sweden

[73] Assignee: Chicago Pneumatic Tool Company, Utica, N.Y.

[21] Appl. No.: 502,068

[22] Filed: Mar. 29, 1990

[51] Int. Cl.[5] ..... B25D 15/00

[52] U.S. Cl. ..... 173/93.5; 81/463; 464/25

[58] Field of Search ..... 173/12, 93, 93.5; 464/25; 192/56 F, 58 R; 81/463

[56] References Cited

U.S. PATENT DOCUMENTS

| | | | |
|---|---|---|---|
| 2,964,151 | 12/1960 | Eckman . | |
| 3,082,742 | 3/1963 | Vilmerding | 121/11 |
| 3,187,860 | 6/1965 | Simmons . | |
| 3,214,941 | 11/1965 | Shulters | 64/26 |
| 3,263,449 | 8/1966 | Kramer | 64/26 |
| 3,354,754 | 11/1967 | Amtsberg | 81/52.4 |
| 3,672,185 | 6/1972 | Schoeps | 64/26 |
| 4,002,212 | 1/1977 | Schoeps | 173/93.5 |
| 4,071,092 | 1/1978 | Wallace | 173/12 |
| 4,553,948 | 11/1985 | Tatsuno | 464/25 |
| 4,635,731 | 1/1987 | Wallace | 173/12 |
| 4,767,379 | 8/1988 | Schoeps | 464/25 |
| 4,785,693 | 11/1988 | Minamiyama et al. | 173/93.5 |
| 4,836,296 | 6/1989 | Brek | 173/93.5 |
| 4,967,852 | 11/1990 | Tatsuno | 173/93.5 |

*Primary Examiner*—Frank T. Yost
*Assistant Examiner*—Scott A. Smith
*Attorney, Agent, or Firm*—Charles L. Johnson, Jr.

[57] ABSTRACT

A hydraulic torque impulse generator uses a dual piston arrangement to provide impacts to a rotative anvil and automatic shut-off and control apparatus for limiting the pressure without reversing the direction of the driving clutch cage, a pressure venting arrangement permitting one impact per revolution.

10 Claims, 3 Drawing Sheets

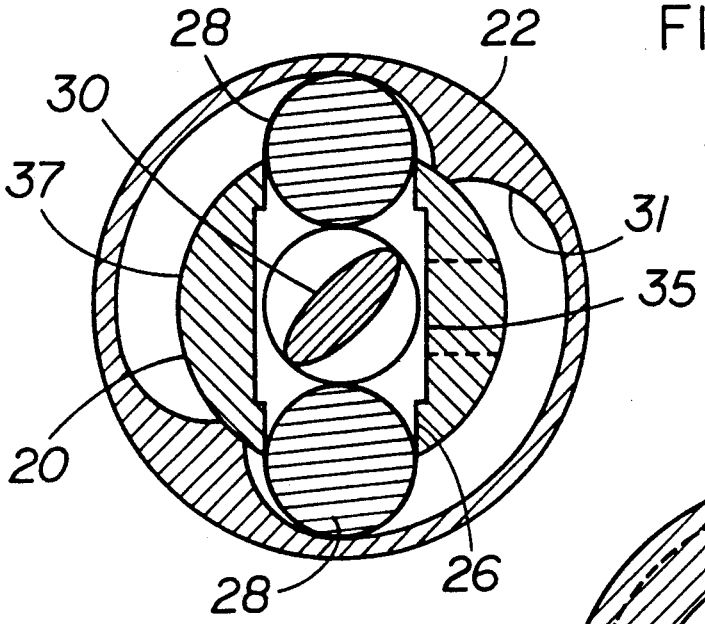
FIG. 2
FIG. 3
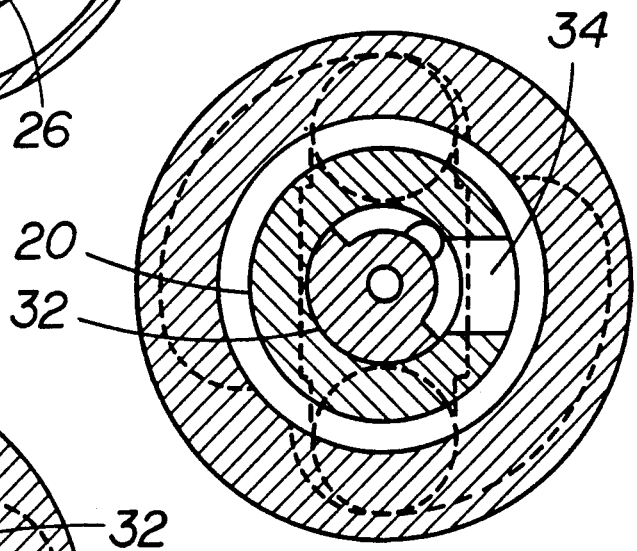
FIG. 4
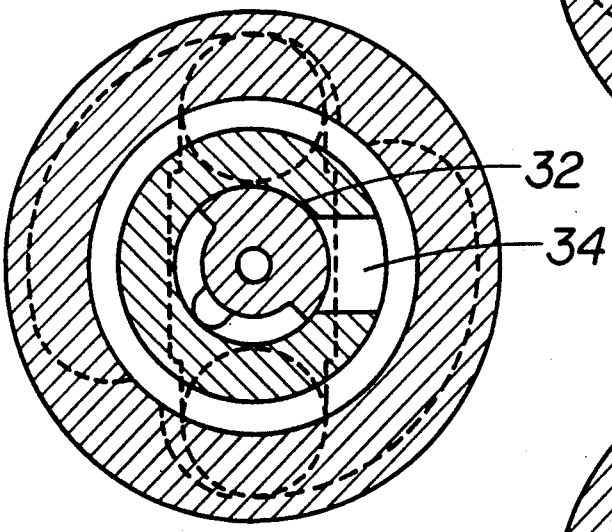
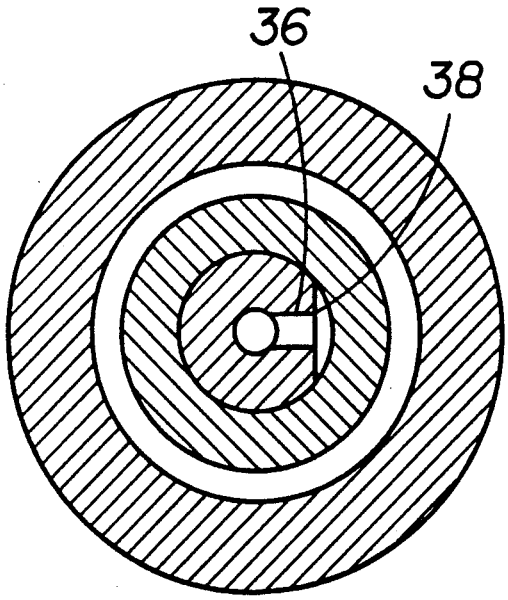
FIG. 5

ADJUSTABLE PRESSURE DUAL PISTON IMPULSE CLUTCH

BACKGROUND OF THE INVENTION

1. Field of the Invention

This invention relates generally to a portable power tool of the impulse type and more particularly to an impulse device designed with alternative torque adjustment arrangements with or without an automatic shut-off.

2. Description of the Prior Art

One example of a prior art device is illustrated in U.S. Pat. No. 4,635,731 wherein the driven output shaft or impulse member has a cam surface driven by a driver which is axially or radially movable in a driving cage mechanism and where the torque developed by the impulse device cyclically varies between zero and a predetermined adjustable maximum quantity. Other examples of the prior art may be seen in the references cited in U.S. Pat. No. 4,635,731, as well as U.S. Pat. No. 4,767,379.

SUMMARY OF THE INVENTION

In accordance with the present invention an impulse type portable power tool is provided which includes a torque-sensing air shut off arrangement which does not require the conventional action of requiring the cage to stop and reverse its direction of rotation. When a device is designed to cause the cage to stop and be forced by the stored energy to rotate in the reverse direction, time is lost out of the tightening cycle. A device of the prior art, so designed, will take longer to do the same work when compared to a device, such as the present invention, that only slows the rotation of the cage.

The invention includes two radial pistons to transmit the kinetic energy of the rotating parts to the anvil, while providing a full revolution of accelerating distance. Two specific alternatives are provided, either (1) two balls or (2) two rollers and two pistons. The invention provides a two ball piston with means to obtain one revolution per blow.

The impulse type tool of the invention utilizes a small and easily controlled leakage area. The only leakage paths are through the bore and around the diameter extension of the cap.

Also, the only one adjustment means is provided to both limit the clutch output and change the torque level at which shut-off occurs. This increases the accuracy of the device.

Further objects and advantages of the present invention will become apparent to those skilled in the art from the following detailed description and the accompanying drawings in which:

FIG. 2 is a transverse cross sectional view of the present invention taken along line 2—2 of FIG. 1.

FIG. 3 is a transverse cross sectional view of the present invention taken along line 3—3 of FIG. 1, with the valve 32 open.

FIG. 4 is a transverse cross sectional view of the present invention taken along line 3—3 of FIG. 1, with the valve 32 closed.

FIG. 5 is a transverse cross sectional view taken along line 5—5 of FIG. 1, with the valve 32 open.

DETAILED DESCRIPTION OF THE INVENTION

Figure 1:
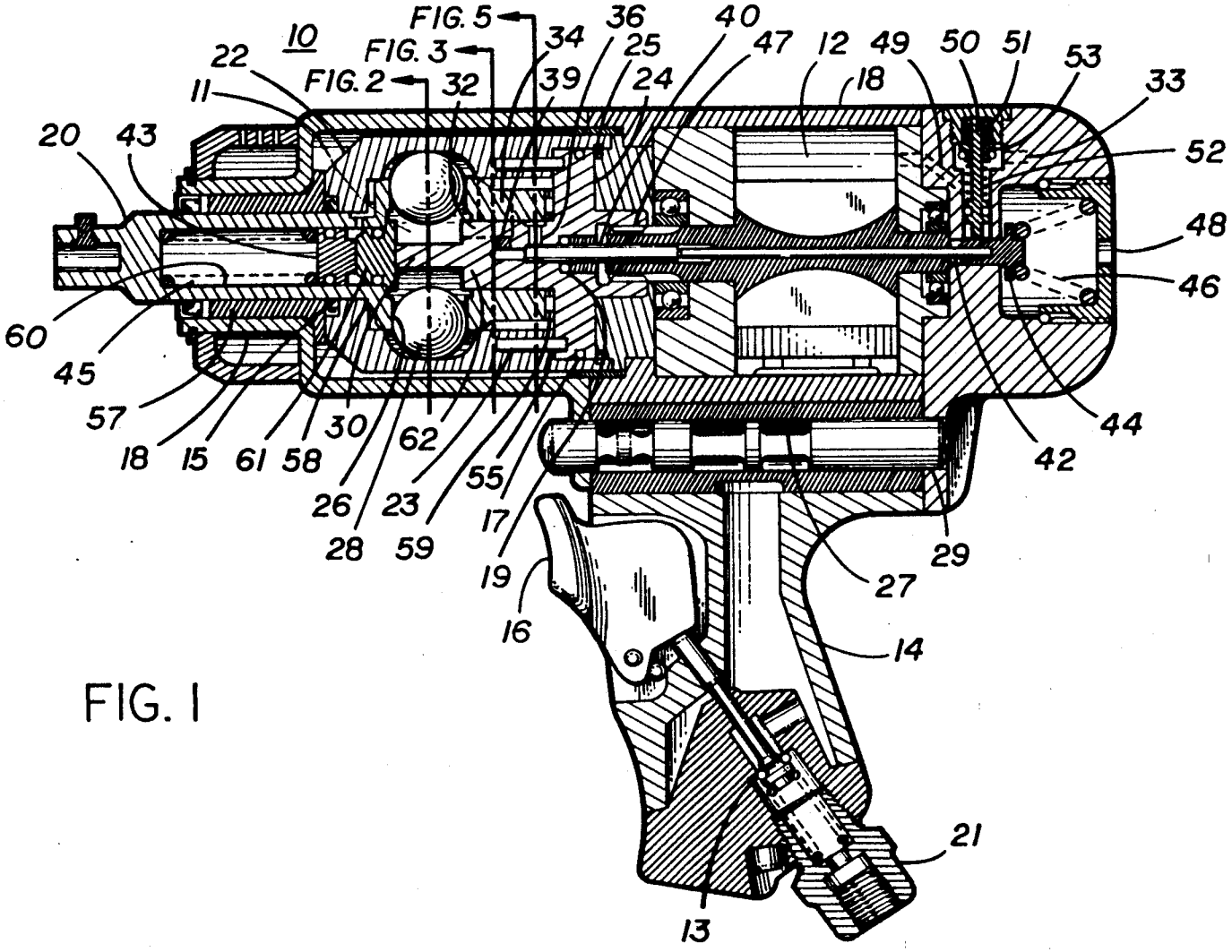
FIG. 1 is a longitudinal cross sectional view of one form of the present invention.

Referring to the drawings, FIG. 1 shows the impulse clutch device 10 in accordance with the present invention which is affixed to an air motor driving unit 12 of well-known construction or to an equivalent electric motor drive.

As shown in FIG. 1 the driving unit 12 may be fitted with a pistol grip 14 and trigger 16. The impulse clutch 10 and driving motor unit 12 are provided with a generally cylindrical housing 18 which may be of one or more pieces. The invention includes an anvil 20 to which a fastening device, not shown, is normally attached.

The impulse clutch 10 is full of hydraulic fluid 11 which is retained in the clutch by seals 15, 17 and 19. The end cap 24 has means 47 to torsionally connect it to a conventional air motor driving unit 12. The end cap 24 is torsionally connected to the cage 22 through two pins 23, and is contained axially by a shoulder 55 on cage 22 and the retaining ring 25.

Still referring to FIG. 1 the anvil 20 is supported for rotation relative to cage 22 by a plane bearing 57 in cage 22 at one end and by a diameter extension of cap 24 at the other end. The anvil 20 is held in axial position by a diameter shoulder 58 and the face of cage 22 at the forward end, the rear end abutting against a thrust bearing 59 on the face of cap 24. The anvil 20 contains a thru bore 26 at right angles to the anvil axis which forms a seal with the two ball pistons 28. The anvil 20 also contains a bore 60 parallel with its axis which accepts the diameter extension 61 of cap 24.

Referring to FIGS. 1 and 2 the end 61 of the diameter extension of cap 24 contains a cam blade 30 which cams the piston balls 28 to their outermost position when the cage 22 and cap 24 turn relative to the anvil 20. To the right of the cam blade 30 as seen in FIG. 1, and as illustrated in FIGS. 3 and 4, is a diameter extension shown as valve 32. This valve 32 alternately covers and opens hole 34 in anvil 20 as the cap 24 turns relative to the anvil 20. As seen on FIG. 1 the next position to the right on the diameter extension of the end cap 24 is an uninterrupted diameter 62 which pilots anvil 20 and provides a seal between the shaft extension 61 and the anvil 20. As may best be seen from FIGS. 1 and 5, the last position on the diameter extension 61 is a hole 36 and flat 38 which is blocked or opened by the spring loaded rod 40. This acts as a relief valve to control the clutch pressure.

Pressure control apparatus is shown in FIG. 1 wherein rod 42 and button 44 transfers the load of spring 46 to rod 40. The load of spring 46 is adjusted by turning the adjustment nut 48. The button 44 in the position shown blocks the closing of the valve assembly. The valve assembly is made up of a valve stem 50 pressed on sleeve 51, spring 52 and a valve 53. The valve 53 is free to move on the stem 50 but is held against the sleeve 51 by spring 52.

The operational cycle of the impulse clutch of the inventions follows. Air is admitted to the motor 12 which causes the cage 22 and anvil 20 to rotate driving a threaded fastener in the tightening direction. When the torque of the fastener offers enough resistance the cage 22 will rotate relative to the anvil 20. The motor 12 accelerates the rotating parts, cage 22 and cap 24, causing the balls 28 to pass over cam lobe 31 and continue accelerating when the valve 32 has hole 34 open. The acceleration continues until balls 28 contact the cam lobe 31 of the cage 22 with valve 32 blocking hole 34. The cam lobe 31 forces the balls 28 into bore 26, compressing the trapped oil between the balls.

This action generates a pressure force on the balls 28 that acts on the cam shape to provide a torsional connection between the anvil 20 and cage 22 transmitting the kinetic energy of the rotating mass to the fastener. This action is repeated until the pressure between the balls equals the preset value of pressure determined by spring 46 and rod 40. At this time, the axial travel of button 44 is sufficient to permit the air pressure to close valve 53 stopping the flow of air to the motor 12. The pressure between the balls 28 is leaked away and the button 44 and valve stem assembly 50 are returned to their original position. The valve 53 remains closed until the operator closes valve 13 which then permits spring 52 to return valve 53 to its original position and the tool is ready for its next cycle.

Figure 6:
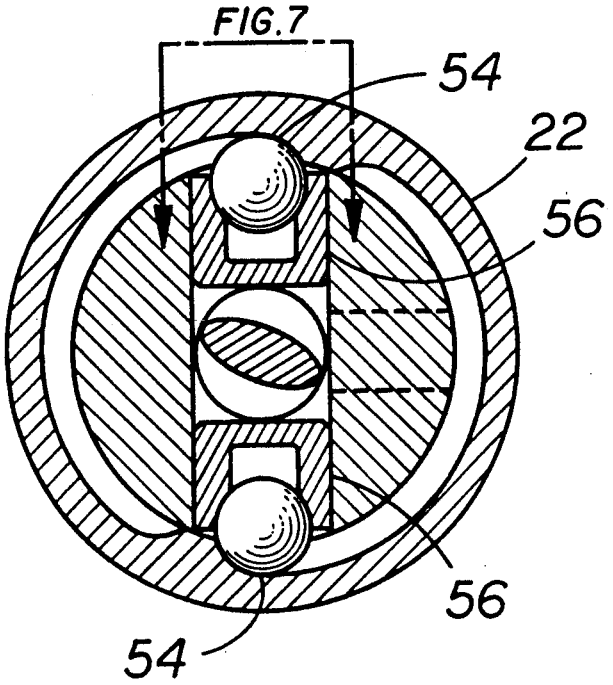
FIG. 6 is a transverse cross sectional view of FIG. 1 showing an alternative roller and piston version.
Figure 7:
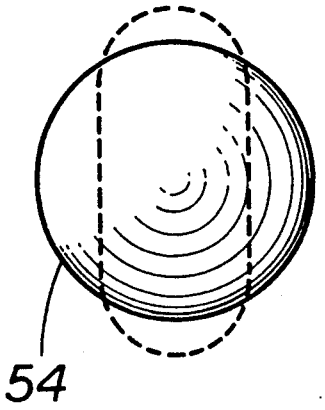
FIG. 7 is a cross section of FIG. 6 taken along line 7—7.

FIG. 6 illustrates an alternative arrangement to that shown in FIG. 2, wherein the ball pistons 28 of FIG. 2 may be replaced by two rollers 54 and two pistons 56. The piston arrangement of FIG. 6 has a longer sealing path than the ball arrangement of FIG. 2 and therefore hydraulic fluid leakage would be reduced. The rollers 54 have more contact area with the cage 22 cam lobe 31 than the balls 28 which permit them to carry a greater load than the balls. FIG. 7 is a detail of FIG. 6.

The operation of the apparatus of the invention will now be described in greater detail.

High pressure air is connected at the inlet 21. When the operator opens valve 13 air is fed through chamber 27 of the reverse valve 29 through porting not shown to port 33 of the valve assembly. Air passes through the valve 53 out port 49 to the air motor 12 causing it to rotate. The anvil 20 and impulse clutch rotate as a unit, until the threaded fastener offers resistance to turning. At that time, the cage 22 and cap 24 turn relative to the anvil 20.

Figure 8:
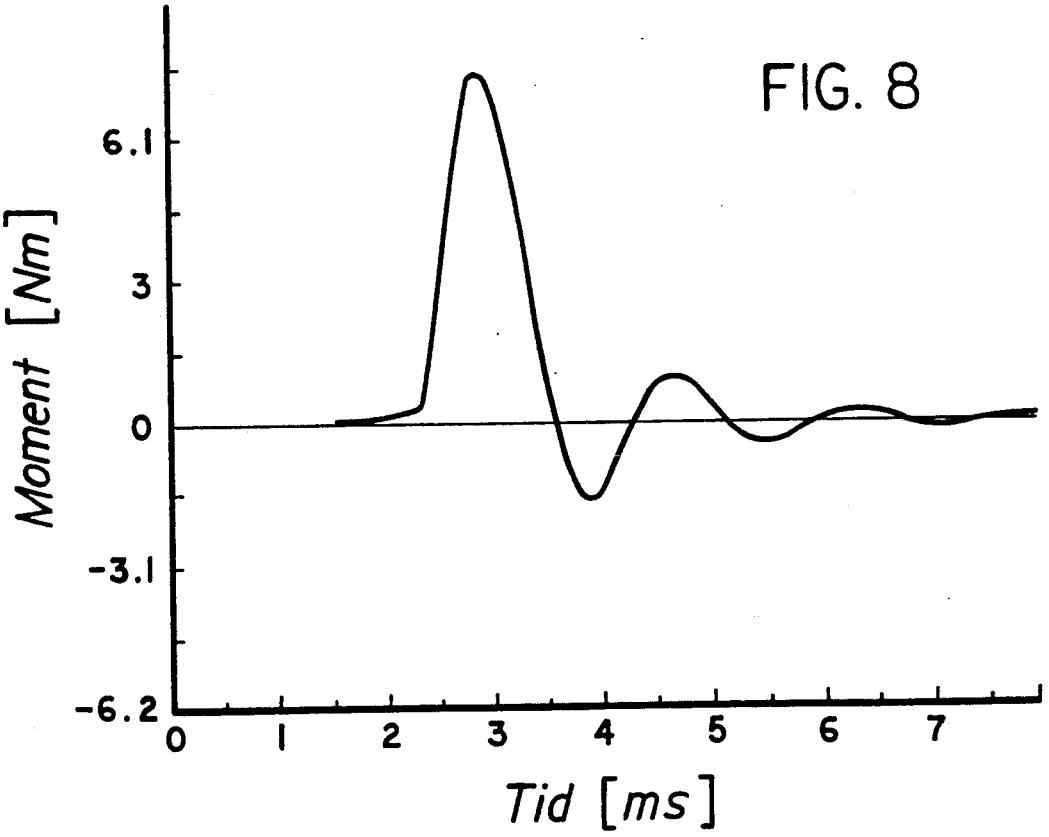
FIG. 8 is an impulse graph resulting from the operation of the invention.

Referring to FIG. 2, the piston balls 28 come into contact with the cam lobes 31 on the cage 22. The cam lobes force the balls 28 into the anvil 20 bore 26. If the valve 32 is in the position shown in FIG. 3, then the fluid is transferred from bore 26 on the anvil through port 34 and no pressure is generated. The cage 22 continues to rotate relative to the anvil 20. The cam blade 30 forces the balls 28 back to their outward position causing the fluid to flow through port 34 to refill bore 26 on the anvil 20. The piston balls 28 again contact the cam lobes 31 on the cage 22. The valve 32 has now been rotated to the position shown in FIG. 4. The cam shapes 31 force the balls 28 into bore 26, which compresses the trapped oil between the piston balls 28. This action generates a pressure force on the balls 28 that acts on the cam shape 31 and bore 26 to provide a torsional connection between the anvil 20 and cage 22. Since anvil 20 is connected to the threaded fastener and the cage 22 is connected to the rotating mass, this torsional connection transmits the kinetic energy of the rotating mass to the threaded fastener. The value of torque that can be transmitted through this torsional connection is proportional to the angle of the cam shapes 31 and the value of pressure acting on the balls 28. FIG. 8 shows a typical pulse transmitted to the fastener.

The movement of the balls 28 into bore 26, while in the sealed zone, is a stroke. The sealed zone is defined by the end of the relief 35 and the intersection of bore 26 with the diameter 37 on the anvil 20.

To generate a pressure, the stroke must be sufficient to overcome leakage flow that occurs between the balls 28 and bore 26 and also compress the volume of oil trapped between the balls 28. The volume of oil that can be lost by this leakage flow is a function of time and therefore a function of the relative speed between the anvil 20 and cage 22. After the free running phase of the tightening cycle is complete, the work holds the anvil 20 stationary. The motor accelerates the cage 22, when balls 28 contact the cam shape 31 on the cage, the balls are forced up the cam ramp into bore 26. The pressure generated by this action temporarily locks the anvil and cage together, which in turn causes the anvil to rotate and turn the fastener in the tightening direction.

The leakage flow around the balls 28 decreases the pressure between the balls which allows the cage to once again turn relative to the anvil, which in turn, forces the balls further up the cam ramp increasing the pressure between the balls and locking the anvil and cage together again. This action continues until the rotating parts have delivered their kinetic energy to the fastener or the balls 28 are forced through the sealed zone.

The length of the sealed zone is designed to permit the balls 28 to be forced through it before the rotating parts stop. A portion of kinetic energy is left in the rotating parts, but this adds to the value of kinetic energy available at the next impulse. The larger the value of torque the fastener has been tightened to a greater pressure between balls 28 is needed to lock the anvil and cage together. Therefore, the balls must be forced further into bore 26 to lock the anvil 20 to the cage 22. The length of the seal zone also determines the maximum pressure and therefore the maximum torque that can be transmitted through the clutch.

To be a useful device for tightening threaded fasteners, the output of the clutch must be adjustable. This is true since the desired tightening torque of threaded fasteners is not the same for all fasteners. Tools having similar devices to that of the subject design use a leakage flow adjustment or a stroke adjustment to control the pressure the clutch develops, thus controlling the torque output of the clutch. The present invention may use either of these means to adjust the torque output of the clutch.

Referring to FIG. 1, the rod 40 has the pressure that is developed between the two balls acting on its end face. It is connected to chamber 26 through the valve 32 by port 39. When the pressure force acting on rod 40 exceeds the value of spring 46 the rod 40 will move to open port 36. This action connects the high pressure between the balls to low pressure, thus limiting the value of pressure between the balls 28.

FIG. 8 shows graphically a typical pulse and indicates that the time of a pulse is less that 5 milli seconds. Therefore, the rod 40 must move to open port 36 in less than this time to limit the pressure developed between the balls 28. The total mass (Mt) to be moved is the mass of rod 40, rod 42, button 44 and spring 46. The distance rod 40 must travel to open port 36 will be designated (S) and the time to move this distance is (T). The force of spring 46 will be referred to as (F) and the area of the rod 40 face will be (A). The pressure between the balls 28 may be calculated by the following formula:

$$P = \frac{2\,SM}{At^2} + F/A$$

The pressure between the balls 28 can be varied by increasing or decreasing the force (F) of spring 46, thus adjusting spring 46 will adjust the torque output of the clutch. The clutch will drive a threaded fastener to a pre-set torque value and will not over tighten the fastener regardless of how long the tool is cycled on the fastener. If the device did not have a shut-off the operator would be required to judge when the tool has finished tightening the fastener before he shuts off the tool.

The invention has an automatic shut-off valve that will shut the tool off once it has tightened the fastener to the pre-set torque. The movement of rod 40 is used to operate a shut-off valve, when the pressure between balls 28 has reached the pre-set value. The movement of rod 40 is made up of the distance the rod moves to open port 36 to reduce the pressure between balls 28 plus the movement of rod 40 resulting from the distance spring 46 is compressed to absorb the kinetic energy stored in the rods, as a result of their initial movement. The movement of rod 40 is proportional to the value of pressure in excess of the pre-set pressure resulting from the load of spring 46.

When the travel of rod 40, transmitted to button 44, is great enough to move the button from under the valve stem 50 the air pressure will force the stem to move toward the tools center. The pressed on collar 51 causes the valve 53 to move with the stem into its closed position. Once the pressure pulse between balls 28 has disappeared, spring 46 will return rod 40 and button 44 to their original position. This action will raise valve stem 50 to its original position, but valve 53 will remain closed. The air pressure will hold valve 53 on its seat overcoming the force of spring 52. Once the operator closes valve 13 spring 52 will return valve 53 to its original position against the pressed collar 51.

The chamber 41 behind the piston 43 located at the drive end of the anvil 20 is an expansion chamber. Due to energy losses through the clutch, the temperature of the oil will increase when the tool is cycled. Since oil expands with increased temperature, the piston 43 will be forced back against spring 45 providing space for the increased oil volume. This action prevents an increase in the clutch pressure and avoids seal damage.

What is claimed is:

1. A hydraulic torque impulse generator comprising, a rotatable anvil having a working implement connection means, and a rear portion, a drive member coaxially rotatable with said anvil and comprising a hydraulic fluid chamber in which said rear anvil portion is received, and an impulse clutch arranged between said drive member and said rear anvil portion, characterized in that said impulse clutch comprises two radially extending cylinder bores located in said rear anvil portion in a substantially coaxial disposition to each other, two radially acting piston elements sealingly guided in said cylinder bores and defining between them a single pressure chamber, and said drive member being provided with cam means for urging repeatedly and simultaneously, at relative rotation between said drive member and said anvil, said piston elements towards each other against a rapidly increasing fluid pressure in said pressure chamber, thereby accomplishing a transfer of torque impulses from said drive member to said anvil.

2. Impulse generator according to claim 1, wherein said cam means comprises a pair of diametrically opposite cam lobes located on the inner peripheral wall of said hydraulic fluid chamber.

3. Impulse generator according to claim 1 or 2, wherein an auxiliary cam means is associated with said drive member and arranged to move said piston elements outwardly after each of their inwardly directed movements.

4. Impulse generator according to anyone of claims 1, wherein said piston elements comprise balls.

5. Impulse generator according to claim 1, wherein a first valve means is associated with said drive member and a second valve means is associated with said anvil, said first and second valve means being arranged to cooperate and establish a fluid escape from said pressure chamber every second time said piston elements are urged towards each other, thereby providing for one impulse only during each full relative revolution between said drive member and said anvil.

6. An anvil capable of rotative motion, to which a fastening device may be connected for tightening fasteners, a rotataive driving unit for providing pneumatic driving power, an impulse clutch, including a radially moving piston, operatively connected between the said anvil and driving unit whereby the driving unit driving power is imparted to the anvil, characterized in that the piston impulse clutch is cammed (31) and vented (34) so as to provide one impact on the anvil (20) by the piston for each complete revolution of the driving unit.

7. The apparatus of claim 6, wherein a first valve means is associated with said driving unit and second valve means is associated with said anvil, said first and second valve means being arranged to cooperate as part of the impulse clutch to establish a fluid escape from the impulse clutch so as to provide one impulse on the anvil for each full relative revolution between said driving unit and said anvil.

8. An impulse generator according to claim 6 or 7, wherein an auxiliary cam means is associated with said drive member and arranged to move said piston element outwardly after each piston's inwardly directed movements.

9. The apparatus of claim 6, wherein the piston is a ball.

10. The apparatus of claim 6, wherein the piston includes a roller and U-shaped drive member.

* * * * *